United States Patent [19]

Palisin, Jr.

[11] 3,972,785

[45] Aug. 3, 1976

[54] ELECTROPLATING RACK

[75] Inventor: Stephen P. Palisin, Jr., South Euclid, Ohio

[73] Assignee: The Empire Plating Company, Cleveland, Ohio

[22] Filed: June 17, 1974

[21] Appl. No.: 479,617

[52] U.S. Cl. ..... 204/297 W; 204/297 R; 204/DIG. 7

[51] Int. Cl.[2] ..... C25D 17/08

[58] Field of Search ..... 204/297 R, 297 W, DIG. 7, 204/297 M

[56] References Cited

UNITED STATES PATENTS

| | | | |
|---|---|---|---|
| 148,409 | 3/1874 | Bush | 204/297 W |
| 258,214 | 5/1882 | Brinckmann | 204/297 W |
| 2,196,663 | 4/1940 | Isele | 204/297 W |
| 2,505,531 | 4/1950 | Ellwood | 204/297 M |
| 2,523,973 | 9/1950 | Snyder | 204/297 W |
| 2,760,923 | 8/1956 | Boguski | 204/34 |
| 2,760,929 | 8/1956 | Shepard et al. | 204/241 |
| 2,911,347 | 11/1959 | Gutzmer | 204/297 M |
| 3,176,850 | 4/1965 | Rosner | 211/117 |
| 3,607,707 | 9/1971 | Chenevier | 204/297 W |

OTHER PUBLICATIONS

Western Electric Tech. DIG., No. 25 pp. 73 and 74 by Wyatt Jan. 72.

Western Electric Technical Digest No. 19 by Boucato et al., pp. 17 and 18 July 1970.

Plating Rock Manual by Belke, pp. 29, 34, 35 and Plate 8 pub. by Belke Mfg. Co., Chicago 1947.

*Primary Examiner*—F.C. Edmundson

*Attorney, Agent, or Firm*—David A. Burge Co.

[57] ABSTRACT

An electroplating rack has a framework including a pair of interconnected uprights which support two vertically spaced pairs of arms. Removable pairs of inserts extend between the distal ends of the arms. Electrode bars underlie the pairs of inserts and define exposed, upwardly facing electrode surfaces. The inserts are provided with spaced apertures to support long, thin articles stood on end with their lower ends contacting the electrode surfaces. Interchangeable inserts having apertures of different sizes enable the racks to efficiently support long thin articles of different sizes.

10 Claims, 4 Drawing Figures

ELECTROPLATING RACK

BACKGROUND OF THE INVENTION

1. Field of the Invention

The present invention relates to electroplating racks and more particularly to a novel and improved rack for supporting a plurality of relatively thin elongated articles in spaced relationship for electroplating.

2. Prior Art

In modern automatic plating systems, a plurality of rack assemblies are used to support articles to be plated. The racks are hung on a bus bar positioned above tanks containing cleaning, plating and washing solutions. A programmed drive system sequentially moves the racks along the bus bar to prescribed stations over the tanks, lowers the bus bar to submerge the articles in the tank-carried solutions, and raises the bus bar to drain the solutions from the articles and racks before the racks are advanced to the next station.

The articles to be plated are used as cathodes of electrolytic cell. The anode is formed from the metal to be plated. The electrolyte is a metal salt solution which presents ions of the plating metal to the cathode for deposition. As metal ions are depleted from the electrolyte, they are replenished by the anode.

The racks should be capable not only of securely holding a plurality of articles in properly spaced relationship, but should also provide a low impedance current path and make good electrical contact with the supported articles. Only a minimum surface area of the articles should be shielded from the electrolyte. The racks should be capable of holding a maximum number of articles to accommodate high production volumes, and yet should be of sufficiently simple construction so that circulation of the electrolyte is not inhibited.

Ideally the racks incorporate a minimum number of parts so they can be economically manufactured. The racks should occupy a minimum of storage space. The racks should be capable of accommodating different sizes of articles in an efficiently spaced arrangement.

Still another consideration in the design of electroplating racks is they should permit the expedient racking and unracking of articles.

A number of proposals have been made in the prior art to provide electroplating racks designed to accommodate long, thin articles. Many of these proposals are designed to suspend the long articles horizontally. Horizontal suspension is undesirable for a number of reasons, including the fact that it necessitates the use of long tanks to hold the cleaning, plating and washing solutions. When these long tanks are placed side-by-side in an automated production system, the system occupies an unacceptably large amount of floor space.

Most known racks which support long articles vertically are not well adapted to accommodate articles of a wide variety of sizes. Typically the racks are designed to accommodate a prescribed number of long articles regardless of their size. While such racks may efficiently hold two dozen 2 inch diameter rods in closely spaced relationship, two dozen ¼ inch diameter rods supported at the same on-center spacing is a highly inefficient arrangement.

SUMMARY OF THE INVENTION

The present invention overcomes the foregoing and other drawbacks of the prior art by providing an electroplating rack having interchangeable inserts for holding a plurality of long thin articles in closely spaced relationship.

A framework includes pair of spaced uprights formed from electrically conductive metal. A pair of hooks are provided to hand the rack from the bus bar of an automatic plating apparatus. The uprights carry vertically spaced pairs of arms. The uprights are connected near their lower ends by transversely extending bars. The bars are formed from an electrically conductive metal. The framework is coated with an electrically insulative material except in the regions of the hooks and in regions extending across the tops of the bars where exposed, upwardly facing electrode surfaces are defined.

Pair of inserts are removably carried by the distal ends of the arms at vertically spaced positions above the bars. The inserts are provided with spaced apertures for receiving and supporting a plurality of long, thin articles. The articles are supported on end with their lower ends in electrically conductive engagement with the electrode surfaces on the bars. By providing a number of different types of inserts having spaced apertures of different sizes, long, thin parts of a wide variety of shapes and sizes can be efficiently accommodated on the racks.

In the preferred embodiment, the inserts are each held in place by a pair of wires which extend between the pairs of arms. The inserts are carried atop the wires. Hooks carried on the wires extend around opposite sides of the inserts and removably hold them in place.

One advantage of this type of rack structure is the ease with which the racks can be restructured to accommodate long, thin parts of different sizes. All that need be done, is to remove the inserts presently on a rack, and replace them with new inserts having apertures of a different size.

Another advantage of this type of rack structure is the ease with which plated articles can be unracked. The rack can simply be inverted to discharge the articles into a receptacle.

As will be apparent from the foregoing discussion, it is a general object of the present invention to provide a novel and improved electroplating rack.

Other objects and a fuller understanding of the invention may be had by referring to the following description and claims taken in conjunction with the accompanying drawings.

DESCRIPTION OF THE PREFERRED EMBODIMENT

Figure 1:
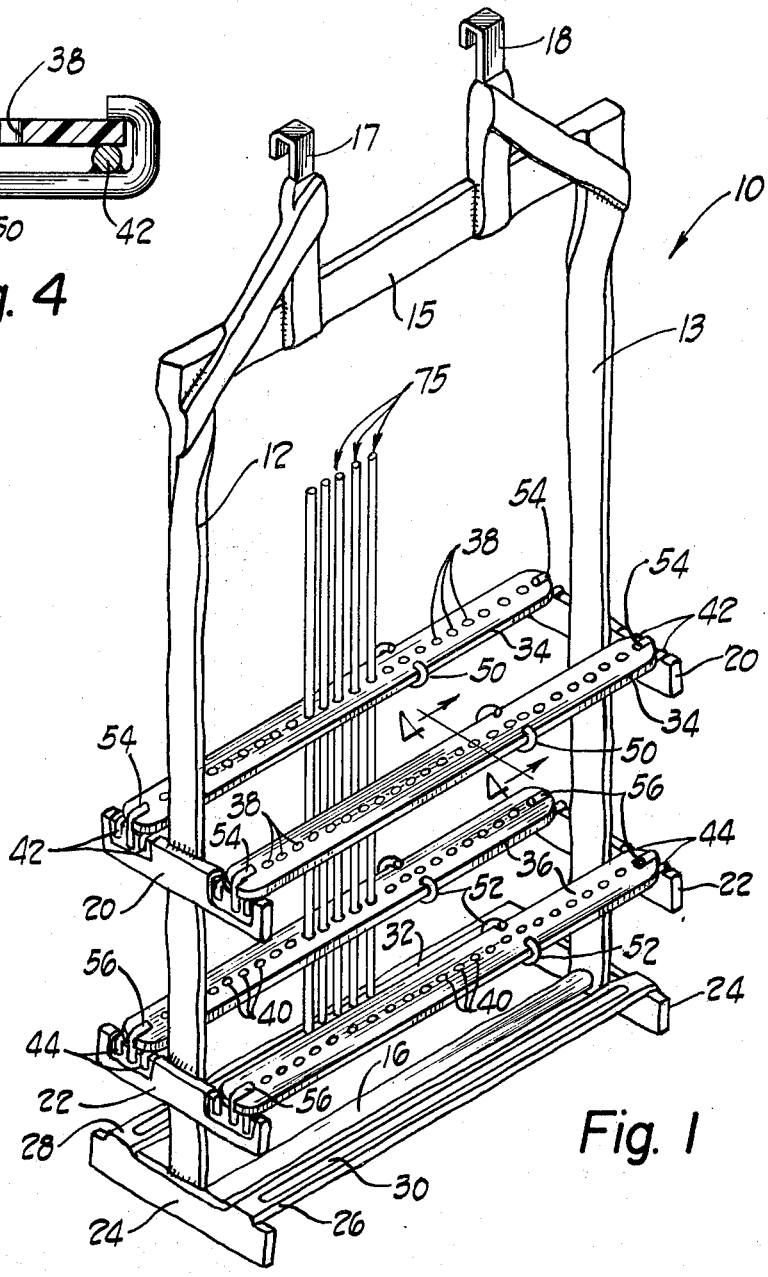
FIG. 1 is a perspective view of a rack constructed in accordance with the present invention.

Referring to FIG. 1, an electroplating rack is shown generally at 10. The rack 10 includes a pair of uprights 12, 13 top and bottom crossbars 15, 16, and a pair of hooks 17, 18 for supporting the framework from the bus bar of an automatic electroplating apparatus. Vertically spaced pairs of arms 20, 22, 24 are carried by the uprights 12, 13. A pair of bars 26, 28 extend between distal end regions of the lower pair of arms 24.

The uprights 12, 13, the crossbars 15, 16, the hooks 17, 18, the arms 20, 22, 24 and the bars 26, 28 define a rigid framework. An electrically insulative coating covers this framework except in the regions of the hooks 17, 18 and in regions extending across the tops of the bars 26, 28 which define exposed, upwardly facing electrode surfaces 30, 32.

Pairs of inserts 34, 36 are carried by the distal end regions of the arms 20, 22 at vertically spaced locations above the bars 26, 28. The inserts 34, 36 are preferably formed from an electrically insulative plastic material and are provided with a plurality of spaced apertures 38, 40 for receiving articles to be plated, indicated generally by the numeral 75.

Figure 4:
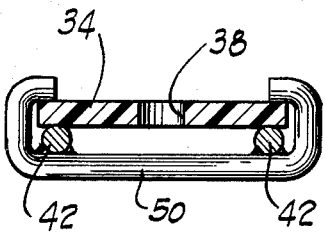
FIG. 4 is an enlarged cross-sectional view as seen from the plane indicated by the line 4—4 in FIG. 1.

The inserts 34, 36 are removably supported on spaced pairs of wires 42, 44 which extend between the arms 20, 22. As is best seen in FIG. 4, hooks 50, 52 carried on the wires 42, 44 extend around opposite sides of the inserts 34, 36 to removably hold the inserts 34, 36 in place atop the wires 42, 44. Opposite ends of the inserts 34, 36 are slotted to receive hooks 54, 56 carried by the arms 20, 22.

Figure 2:
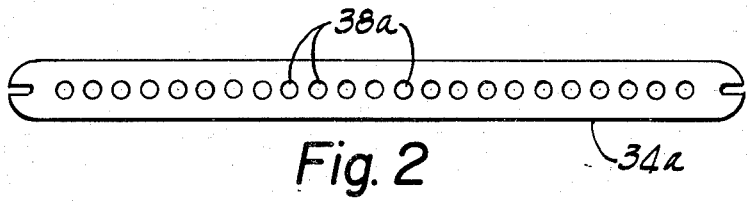
FIGS. 2 and 3 are enlarged top plan views of different inserts which can be used in the rack of FIG. 1.
Figure 3:
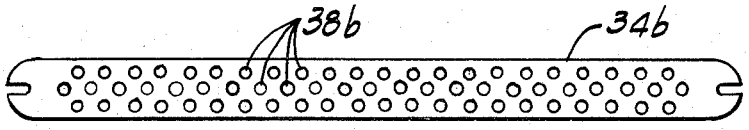

Referring to FIGS. 2, 3, alternate examples of inserts 34*a*, 34*b* which can be used with the rack 10 are shown as having apertures 38*a*, 38*b* of larger and smaller sizes, respectively, than those shown in the inserts 34, 36 of FIG. 1. The inserts 34, 34*a*, 34*b*, 36 are sufficiently flexible to permit one end region to be bowed upwardly from beneath the hooks 54, 56, whereafter the insert is removed from the rack 10 by moving it longitudinally from beneath the hooks 50, 52. Replacing an insert on the rack 10 is accomplished by reversing this removal procedure.

In operation, long, thin parts 75 to be plated are positioned on end in the rack 10 with their lower ends in electrically conductive engagement with the electrode surfaces 30, 32. After the articles 75 have been plated, they can easily be unracked from the rack 10 by inverting the rack 10 to discharge the articles 75 into a receptacle.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and the scope of the invention as hereinafter claimed.

What is claimed is:

1. An electroplating rack comprising:

a. an electrically conductive framework including a pair of spaced uprights;

b. an electrically conductive structure extending between and rigidly connecting said uprights near the lower ends thereof;

c. an electrically insulative material covering said framework and said structure except in a region on said structure where an exposed, substantially upwardly facing electrode surface is defined;

d. a pair of non-electrically conductive members removably carried by said framework at vertically spaced positions above said surface, said members being provided with a plurality of spaced formations for receiving and supporting a plurality of elongated first articles on end with portions of their lower ends in electrically conductive engagement with said surface; and, e. at least one additional non-electrically conductive member adapted to be interchanged with selected of said pair of members and having a plurality of spaced formations of a different configuration than the formations of said selected of said pair of members, whereby when said additional member is interchanged with said selected of said pair of members, the rack will receive and support a plurality of elongated second articles having configurations which differ from those of the first articles.

2. The rack of claim 1 additionally including first and second pairs of spaced elongated elements extending between said uprights, one of said pairs extending alongside one of said members and the other of said pairs the other of said pair of members.

3. The rack of claim 2 additionally including a plurality of support formations carried around opposite sides of their respective members to releasably connect said members and said elements.

4. The rack of claim 1 wherein said spaced formations are apertures formed through said members.

5. An electroplating rack comprising:

a. an electrically conductive framework including a pair of spaced interconnected uprights;

b. three pairs of vertically spaced arms carried on said uprights, each of said arms having a pair of ends extending in opposite directions from its associated upright;

c. the lowermost pair of arms being electrically conductive and being interconnected by electrically conductive structure;

d. said framework including said arms and said structure being coated with an electrically insulative material except in regions where two exposed, upwardly facing electrode surfaces are defined on said structure;

e. two pairs of non-electrically conductive first insert means removably carried by said upper two pairs of arms, each pair of said insert means overlying a separate one of said surfaces at vertically spaced positions thereabove, each of said insert means being provided with a plurality of spaced apertures for receiving and supporting a plurality of relatively long, thin articles on end with portions of the lower ends of the articles in electrically conductive engagement with said surfaces; and, f. at least one additional pair of non-electrically conductive insert means adapted to be interchanged with a selected pair of said first insert means, said insert means of the additional pair each being provided with a plurality of spaced apertures having a different size than the apertures of said selected first insert means.

6. The rack of claim 5 additionally including separate pairs of spaced wires underlying each of said first insert means and extending between associated ones of said arms for supporting said first insert means.

7. An electroplating rack for selectively receiving and supporting first and second types of differently configured, elongated articles, comprising:

a. a framework including a pair of spaced side members and an electrically conductive structure located between the side members;

b. an electrically insulative material insulating exposed portions of the structure except in a region where an exposed, substantially upwardly facing electrode surface is defined;

c. a pair of first non-electrically conductive members removably supported by the framework and located at substantially vertically spaced positions above the electrode surface;

d. each of the pair of first members having a plurality of formations adapted to receive and retain portions of elongated articles having a first configuration with lower end portions of the first configuration articles in electrically conductive engagement with the electrode surface; and, e. at least one additional non-electrically conductive member adapted to be interchanged with a selected one of the pair of first members, the additional member having a plurality of formations which differ from the selected first member formations whereby the additional member when interchanged with the selected first member adapts the rack to receive and support elongated articles having a second configuration different from the first configuration, with lower end portions of the second configuration articles in electrically conductive engagement with the electrode surface.

8. An electroplating rack, comprising:

a. an electrically conductive framework including a pair of spaced uprights and a pair of substantially horizontally extending members interconnecting said uprights;

b. three pairs of vertically spaced arms with one arm of each pair supported on one of said uprights and with the other arm of each pair being substantially horizontally paired therewith and supported on the other of said uprights;

c. the lowermost pair of arms being electrically conductive and being interconnected by a spaced pair of electrically conductive members;

d. said framework including said arms and said members being insulated with an electrically insulative material except in regions on said bars where exposed, substantially upwardly facing electrode surfaces are defined;

e. two pairs of non-electrically conductive flexible inserts removably, interchangeably carried on the upper two pairs of said arms, each pair of inserts overlying a separate one of said surfaces at vertically spaced positions thereabove; and, f. the inserts of each pair being provided with an equivalent number of substantially aligned apertures for receiving and supporting a plurality of long, thin articles on end with portions of the lower ends of the articles in electrically conductive engagement with said surfaces.

9. The rack of claim 8 additionally including retaining means extending between said upper two pairs of arms alongside each of said flexible inserts to assist in positioning and supporting said flexible inserts.

10. The rack of claim 9 wherein said retaining means are operative to at least partially surround said flexible inserts, and said flexible inserts are bendable for removal from and insertion into said retaining means.

* * * * *